United States Patent [19]

Freebery

[11] Patent Number: 4,516,896

[45] Date of Patent: May 14, 1985

[54] APPARATUS FOR REMOVAL OF PAVING MATERIAL

[76] Inventor: Joseph J. Freebery, 2626 Sherwood Dr., Wilmington, Del. 19808

[21] Appl. No.: 419,051

[22] Filed: Sep. 16, 1982

[51] Int. Cl.[3] ..... E02F 3/96

[52] U.S. Cl. ..... 414/740; 414/722; 294/104; 37/117.5

[58] Field of Search ..... 414/609, 722, 724, 740; 37/117.5; 294/104

[56] References Cited

U.S. PATENT DOCUMENTS

| | | | |
|---|---|---|---|
| 3,275,172 | 9/1966 | Smith | 414/740 X |
| 3,807,589 | 4/1974 | Shovick | 414/740 |
| 4,131,210 | 12/1978 | Everson | 414/740 |
| 4,188,721 | 2/1980 | Ramun et al. | 414/740 X |
| 4,407,626 | 10/1983 | Bruckner | 414/740 |

*Primary Examiner*—Terrance L. Siemens

[57] ABSTRACT

Novel apparatus for removing concrete or blacktop paving and curbing and loading the same for hauling. The novel apparatus is adapted to be fitted onto a standard backhoe and operated off the hydraulic system. It is comprised of a rigid immobile member secured to the inboard surface of the forward arm of the backhoe and a blade attached to the lower extremity of said forward arm. The blade is oriented in the direction of the backhoe and adapted to be pivoted by operation of the said hydraulic system so as to clamp slabs of paving between the blade and the rigid stationary member for lifting and loading.

2 Claims, 4 Drawing Figures

APPARATUS FOR REMOVAL OF PAVING MATERIAL

This invention relates to novel apparatus for breaking and removing pavement and loading fragments of broken pavement into vehicles for removal.

The replacement of paved surfaces such as driveways, sidewalks, streets and even floors of buildings presents the contractor with the initial difficult problem of removing the original paving material to make way for the new. Indeed, the removal is usually a greater problem than the installation of the new surface.

The usual practice is to break up the original paving with air hammers, or in some cases, even manually as with sledgehammers into relatively small pieces which can be loaded into the bucket of a front end loader and then into a truck. Use of this technique imposes definite limits on the physical size of the pieces which can be handled since the pieces must be able to fit into the bucket and must also be manually handleable. Moreover, the front end loader is not well adapted for picking up large pieces of the paving without digging up a relatively large volume of earth with them. Thus, it is frequently necessary to load the pieces into the bucket manually to avoid disturbing the earthen substrate excessively. Manual loading imposes even greater limitations on the size of the pieces which can be handled.

In some cases, the contractor will attempt to remove large pieces of the broken-up paving with a backhoe by clamping them between the bucket and the underside of the arm of the backhoe. This method works reasonably well for picking up the pieces, but very large pieces cannot be handled because when the arm is straightened and raised for loading them over the side of a truck, there is not sufficient clamping power to hold them and they fall.

Both of the described techniques, the best known at the present time, are highly unsatisfactory. Both methods are very time consuming, labor intensive, inefficient and accordingly very expensive.

It is the object of this invention to provide a new, highly efficient device for breaking up paved surfaces, clearing paving material therefrom and loading the material for removal from the work area. It is a further object to provide an attachment which can be installed on a conventional backhoe for accomplishing the stated goals.

Figure 4:
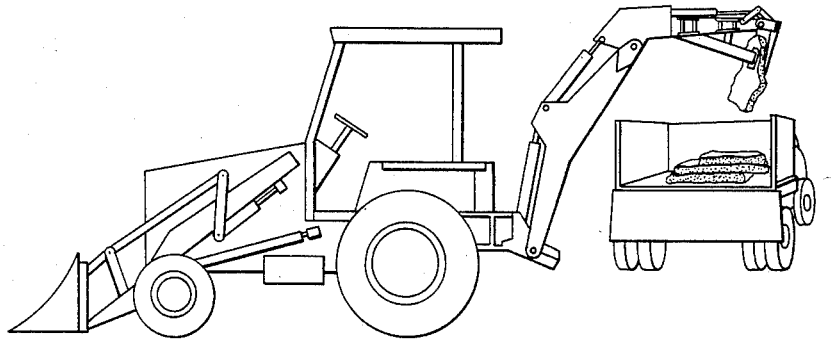
Figure 1:
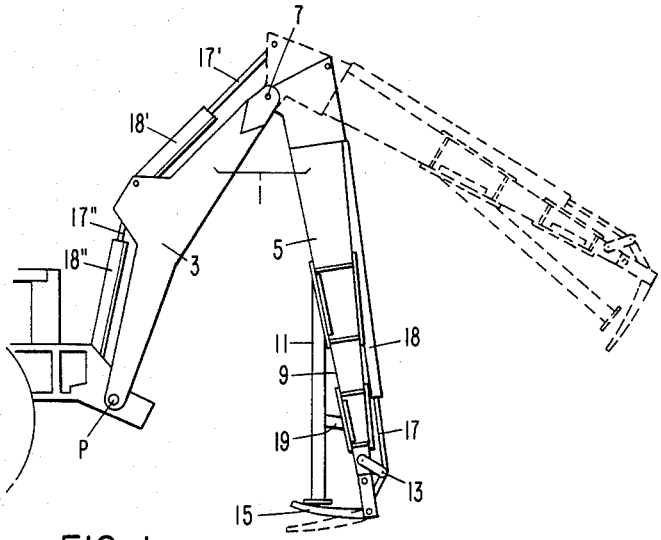
Figure 3:
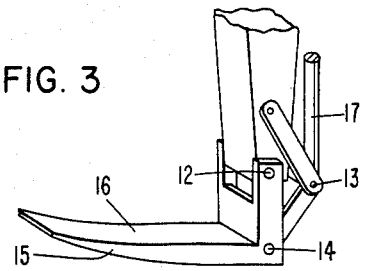
Figure 2:
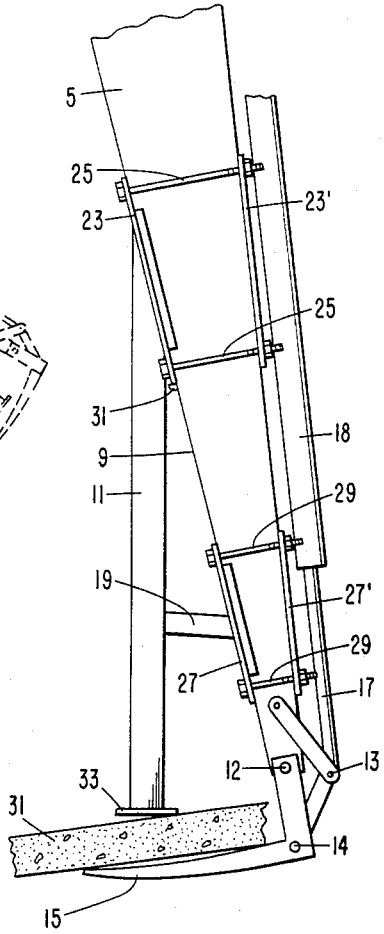

The objects of the invention are accomplished by the unique apparatus depicted in the attached drawings in which FIG. 1 shows the novel apparatus of the invention, FIG. 2 shows detail of the novel apparatus and the means of securing it to the operating machinery, FIG. 3 shows detail of the blade element forming part of the apparatus and FIG. 4 shows the apparatus loading the section of paving onto a truck for removal from the work area.

Referring now to FIG. 1, there is shown a manipulative arm member, shown generally at 1 and being comprised of a forward element 5 and a rear element 3. Rear element 3 is pivotally secured at point P to a mechanized drive unit, not shown, providing a hydraulic power source. At its forward extremity, rear arm element 3 is secured through an elbow-type joint 7 to forward arm element 5, via joint 7. Forward arm element 5 is adapted to pivot in the direction of the mechanized drive unit as shown by the dotted line representation. A rigid, immobile member 11 is attached to the inboard surface 9 of forward arm element 5 and extends from a point several feet above the forward extremity 13 of forward arm element 5 to a point slightly below and behind said forward extremity. Attached to the forward extremity of the forward arm element is a blade 15, adapted to pivot on said forward extremity and to make contact with rigid immobile member 11 at one extremity of its travel. Elements 17, 17′ and 17″ represent the hydraulic pistons and cylinders associated with the mechanized unit to effect the required pivoting movements.

As shown in FIG. 2, rigid immobile member 11 is detachably secured to forward arm element 5 by means of upper mounting plates 23 and 23′ held in place via bolts 25 and lower mounting plates 27 and 27′ held in place by bolts 29. To assist in locating and mounting the rigid immobile member 11 on forward arm element 5, a mounting lug 31 is applied at the appropriate location so that the lower extremity of mounting plate 23 rests thereon when it is properly located. Attached between lower mounting plate 27 and rigid immobile member 11 is a brace 19 which gives increased strength and support to prevent member 11 from twisting when it is under a load in use. At the lower extremity, member 11 is fitted with a flat plate 33 for contacting the paving material to be picked up. If desired, the contacting surface of plate 33 can be faced or roughened to give a tighter grip on the slab to be lifted.

In FIG. 4 there is shown some general detail of blade 15. The blade is relatively wide, shown here being the same width as the forward arm element. It can, however, be wider if desired. The blade tapers toward the free end to enable it to be more readily slipped under the pavement to be lifted. Also, a slight curvature gives added leverage when the blade is being pivoted upward (curled) to lift the slab into contact with immobile member 11. In operation, blade 15 pivots about pivot points 12, 13 and 14.

In the best mode presently contemplated for utilization of the apparatus of this invention, the mechanized unit providing the hydraulic motive force for the required pivoting motions is a backhoe as shown in FIG. 4. The rear arm element 3 and forward arm element 5 are the arms of the backhoe. The bucket of the backhoe is removed and elements 15 and 11, with its associated mounting plates, are detachably mounted on the forward arm of the backhoe.

In operation, the blade 15, in its open position as shown in the dotted lines in FIG. 1, is slipped under one edge of the slab 31 of paving to be removed and drawn in under the slab in the direction of the mechanized unit. When the blade is completely or substantially completely under the slab, it is curled to its closed position by hydraulic cylinder 18 and piston 17 whereby slab 31 is firmly grasped between the blade and the bottom plate 33 of rigid immobile member 11. By manipulation of arm 1, slab 31 is then readily lifted and loaded into a truck for removal from the work site as shown in FIG. 4.

The slabs of paving to be removed can have already been broken up by conventional techniques such as by jackhammers or manually. However, the apparatus of the invention can be employed to break up the paving as well. In the case of concrete such as a sidewalk, it is usually only necessary to sieze the paving and lift and the paving will break at the nearest expansion joints. It it does not, the first attempt will usually so weaken it that it is sufficient simply to sieze it a second time at a point between the first point and an expansion joint and it breaks readily at the joint. After the first slab is removed from a sidewalk, the remainder usually breaks very readily.

In addition to the very substantial time saving made possible by the elimination of most of the manual labor from the paving removal job, there are several other material advantages afforded by the apparatus of the invention. For example, it is no longer necessary to break the slabs of paving into pieces of a size that will fit into the bucket of a loader or that can be handled manually. The size of slab that can be lifted and loaded by the inventive apparatus is limited only by the capacity of the mechanical unit employed to manipulate it. Thus, slabs of 1000 lbs. or more can be loaded.

Another attractive advantage is that the slabs can be stacked relatively neatly in a truck for conveying them from the work site. More important than this even, they can be loaded relatively gently, compared to the way they are presently loaded since the piece can be raised above the truck and lowered onto the truck bed or onto a stack of previously loaded slabs before it is totally released. This method of loading saves a substantial amount of wear and tear on the truck body and suspension.

As suggested hereinabove, the presently preferred mechanized unit for manipulating the apparatus of the invention is a backhoe. This is not critical, however, as any type of unit adapted with a hydraulic or mechanical means of manipulating the arms and blade can be employed. For example, a truck could readily be adapted to operate it. The only limitation is that the unit must be heavy enough to counterbalance the weight of the paving slabs being loaded.

Other variations in design and mounting of the immobile member 11 and blade 5 are possible. Such variations can readily be made within the scope of the invention. For example, it is not necessary that rigid, immobile member 11 be mounted to forward arm element 5 via the mounting plates 23 and 27 as shown. It can be permanently attached, if desired.

The apparatus of the invention finds its greatest application in removing concrete paving as this is usually the most troublesome type of paving to remove. It is also useful with blacktop. In addition to paving, it is useful for removing various types of residential curbing.

What is claimed is:

1. Apparatus for removing paving material from a paved surface comprising, in combination, an arm member comprised of a rear arm element and a forward arm element; said rear arm element being pivotably secured to a mechanized unit and to said forward arm element whereby said forward arm element is adapted to pivot in the direction of said mechanized unit, a rigid stationary member attached to the inboard surface of said forward arm element and having a lower extremity comprising a flat surface, a horizontally tapered elongated blade pivotably attached to the extremity of the forward arm element, being at least as wide as said forward arm element and having a slight curvature on its upper surface, oriented in the direction of the mechanized unit and adapted to pivot in order to make contact with the flat lower extremity of the stationary member whereby a section of paving can be gripped between the upper surface of the horizontally tapered elongated blade and the lower extremity of the stationary member, and means associated with the mechanized unit for causing the aforesaid members to effect pivoting movements in operational sequence.

2. The apparatus of claim 1 wherein said mechanized unit is a backhoe drive unit and said forward and rear arm elements are the arms of a backhoe.

* * * * *